US006296037B1

(12) United States Patent
Ruggles

(10) Patent No.: US 6,296,037 B1
(45) Date of Patent: Oct. 2, 2001

(54) FOAM CORE VANE FOR DOOR AND WINDOW COVERING

(75) Inventor: Bryan K. Ruggles, Salt Lake City, UT (US)

(73) Assignee: Newell Window Furnishings, Inc., Freeport, IL (US)

( * ) Notice: Subject to any disclaimer, the term of this patent is extended or adjusted under 35 U.S.C. 154(b) by 0 days.

(21) Appl. No.: 09/371,226

(22) Filed: Aug. 10, 1999

(51) Int. Cl.[7] ..... E06B 9/30

(52) U.S. Cl. ..... 160/168.1 V; 160/173 V; 160/178.1 V

(58) Field of Search ..... 160/168.1 V, 173 V, 160/177 V, 178.1 V, 236, 330, 900

(56) References Cited

U.S. PATENT DOCUMENTS

| | | | | |
|---|---|---|---|---|
| 3,717,195 | * | 2/1973 | Larranaga | 160/169 |
| 4,877,077 | * | 10/1989 | Ebert | 160/236 |
| 5,119,871 | * | 6/1992 | Schwaegerle | 160/236 |
| 5,121,785 | * | 6/1992 | Ohsumi | 160/236 |
| 5,141,042 | * | 8/1992 | Schwaegerle | 160/236 |
| 5,358,024 | * | 10/1994 | Schwaegerle | 160/236 |
| 5,573,054 | * | 11/1996 | Swopes | 160/236 |
| 5,613,542 | * | 3/1997 | Tuzmen et al. | 160/236 |
| 5,638,881 | | 6/1997 | Ruggles et al. . | |
| 5,797,442 | | 8/1998 | Colson et al. . | |
| 5,996,672 | * | 12/1999 | Kotin | 160/236 |
| 6,015,002 | * | 1/2000 | Biro et al. | 160/236 X |
| 6,058,535 | * | 5/2000 | Firkins, Jr. et al. | 5/653 |

FOREIGN PATENT DOCUMENTS

| | | |
|---|---|---|
| 0692602A1 | 1/1996 | (EP) . |
| 0881351A2 | 12/1998 | (EP) . |
| WO 96/35881 | 11/1996 | (WO) . |

* cited by examiner

*Primary Examiner*—Bruce A. Lev
(74) *Attorney, Agent, or Firm*—Foley & Lardner

(57) ABSTRACT

Foam core vanes useful with door or window coverings and which may be hung vertically or horizontally include an outer fabric cover and an inner foam core. Preferably, the vanes are shaped to have a blunt forward edge, gently curving sides and a pointed rear edge, resembling an air foil. A method of preparing the vanes includes injecting foam producing chemicals into a fold of the outer fabric as the fabric enters a mold section comprised of upper and lower molds moving along tracks. The foam expands to press the fabric into the mold and cures during travel through the mold section. A rotary knife cuts the foam core vanes to the desired length. Preferred foams are urethane and polyisocyanurate foams.

18 Claims, 3 Drawing Sheets

FIG. 1
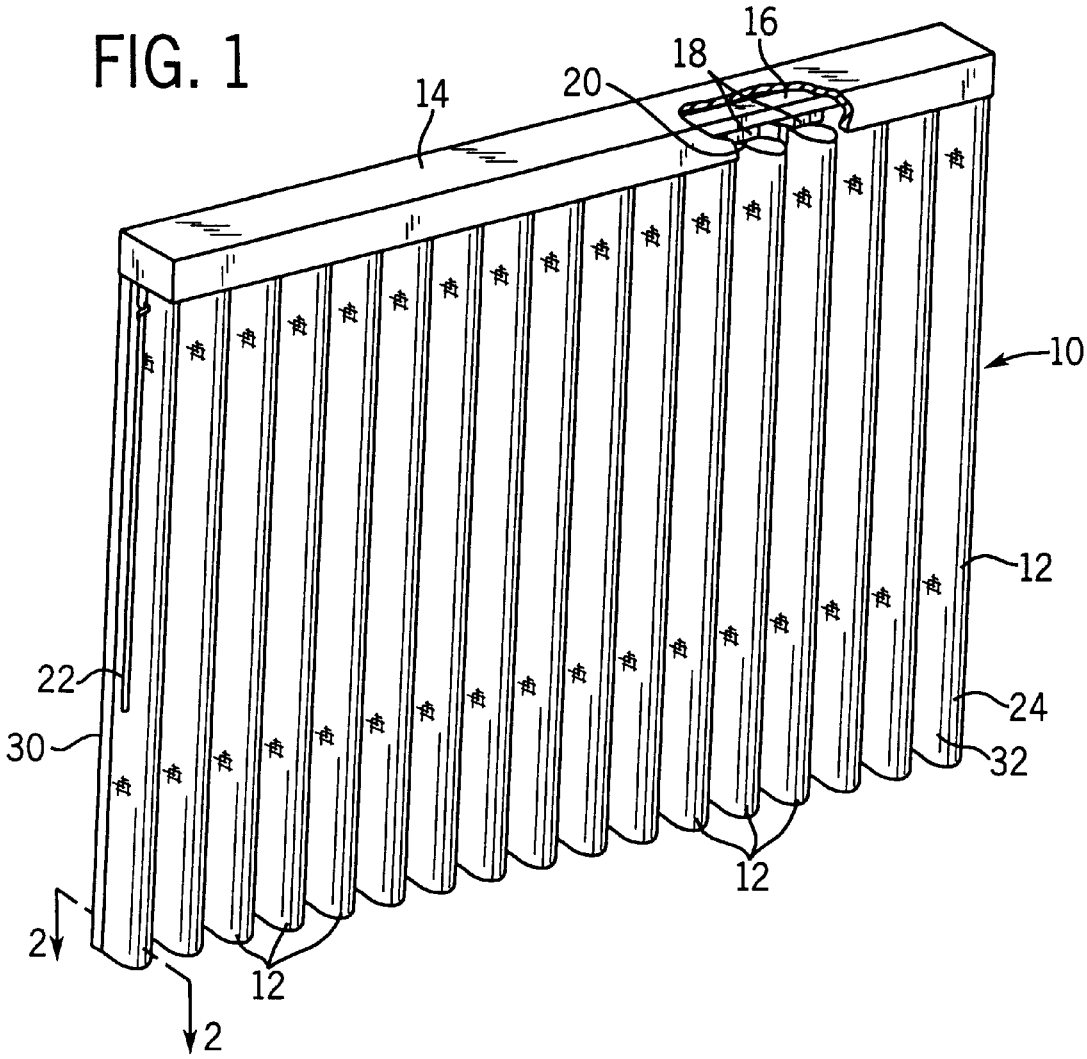
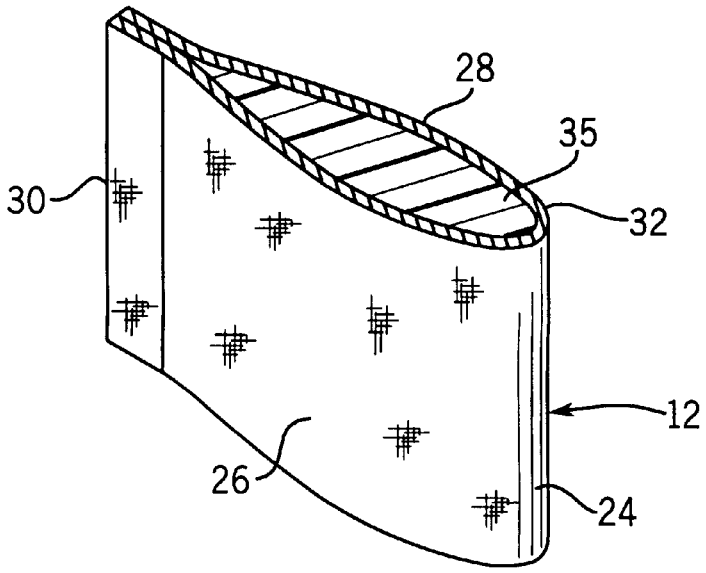
FIG. 2

FOAM CORE VANE FOR DOOR AND WINDOW COVERING

CROSS REFERENCE TO RELATED APPLICATIONS IF ANY

NONE.

BACKGROUND OF THE INVENTION

1. Field of the Invention

The present invention relates generally to the art of coverings for doors and windows and more particularly to the preparation of vanes which may be used for such door or window coverings. In its most preferred embodiment, the present invention relates to novel vane structures which include fabric coverings and foam cores. The present invention also relates to a method of making such foam core products.

2. Description of the Prior Art

A wide variety of coverings for doors and windows are known to the art. These include very old products such as roller shades and venetian-type blinds, as well as the newer types of "soft" window coverings including pleated and cellular blinds and shades, various light control products, and fabric covered vertical blinds. The latter typically include a track which extends across the opening to be covered, with trucks mounted in the track for movement by a wand device or by cords and pulleys. Vanes are attached to the truck and are pivotable about a longitudinal axis of the vanes to open them to a first position and thus permit light to enter a room and to pivot them to a second position in which the vanes overlie one another, in which case privacy is achieved.

Recently, a number of such vertical blind products have been proposed to include hollow fabric vanes, which can include stiffening compounds to insure that the bottom rotates the same amount as the top with no twist top to bottom to achieve an aesthetically pleasing product. Moreover, light weight fabrics have been attached to thin, rigid vanes to achieve a "blind with curtain" product, one of which is disclosed in U.S. Pat. No. 5,638,881 issued to Ruggles, et al. on Jun. 17, 1997 and entitled "BLIND WITH CURTAIN".

It has also been proposed that vanes for door and window coverings can be prepared in a tubular configuration, the cross-section of such vanes simulating an air foil. They are preferably made from material having diagonal, dimensional stability or memory so that they resist stretching in the longitudinal direction. It is also known that with such vanes, a reinforcing strip can be applied to an open end of the vane to provide a positive and durable attachment for supporting the vane from an operating system. One patent describing such vanes is U.S. Pat. No. 5,797,442, issued Aug. 25, 1998 to Colson, et al., for "Vanes For Architectural Covering and Method of Making Same".

The vanes used in the aforementioned Colson, et al. patent have a cross sectional configuration best illustrated in FIG. 6*d* of the patent, i.e., one resembling an air foil. Various techniques are described for insuring that the shape is maintained, such as the use of stiffening compounds, or in the embodiment shown in FIG. 12, the use of a resilient rubber strip along the inside of the vane, i.e. at the blunt end. Various single and double thickness vanes and further vane structures are also disclosed in PCT International Application WO96/35881, to the same inventor, which application claims priority to the parent application of the aforementioned '442 Colson, et al. patent.

FIG. 1 of the Colson, et al. patent discloses a vertical arrangement in which a plurality of the vanes are suspended from a track 30 and are pulled across the opening to be covered using a wand. The vanes may also be rotated to an open, light-admitting position as shown in FIG. 1, or to a privacy position, shown in FIG. 3. If the vane is constructed from transparent or sheer materials, light can be admitted in a diffused pattern into the room when in the closed position, as illustrated in FIG. 4 of this patent.

While new window coverings are shown in the PCT application and the issued Colson, et al. patent, a variety of different and useful door and window coverings employing foil shaped vanes are not disclosed or contemplated. Furthermore, while some thermal insulation benefits may be obtained by using hollow vanes, the amount of insulation is relatively modest. Moreover, the hollow vanes employing fabric are delicate and will quickly become damaged in more severe end use applications. A door or window covering which overcomes these and other disadvantages of the prior art door and window coverings would be a significant advance in this art.

FEATURES AND SUMMARY OF THE INVENTION

A primary feature of the present invention is to provide a new foam core vane for door and window coverings.

Another feature of the present invention is to provide a method of manufacturing a new foam core vane for door and window coverings.

A different feature of the present invention is to provide an improved vane for door and window coverings which may be hung horizontally or vertically.

Another feature of the present invention is to provide a vane for door and window coverings which has high insulation characteristics when the vanes are in a position in which they overlap one another.

Yet another feature of the present invention is to provide a vane for door or window coverings which may be constructed from a wide variety of exterior covering materials.

How the foregoing and other features of the present invention are accomplished will be described in the following detailed description of the preferred embodiment, taken in conjunction with the FIGURES. Generally, however, the features are provided in a vane which, in cross-section, is generally in the shape of an air foil and which includes a fabric exterior and a foam core, preferably a core made of urethane or polyisocyanurate foam. The vanes are manufactured by folding a strip of material to form a receiving area for the deposit of foam-forming chemicals, continuing to fold the material and passing the material into a mold including upper and lower mold cavities which together define the desired final shape for the vane. Preferably, the mold is a traveling mold and the foam expands within the mold to fill the mold and press the fabric covering against the interior mold surface. An adhesive may optionally be applied to connect the two edges of the strip at what becomes the thin or rear of the foil. When the vane leaves the mold area, it is cut into desired lengths by a cutting means, such as a rotary knife. Other ways in which the above and other features of the invention are accomplished will become apparent to those skilled in the art after they have read the remainder of this specification, such other ways falling within the scope of the present invention if they fall within the scope of the claims that follow.

DESCRIPTION OF THE DRAWINGS

FIG. 1 is a perspective view of a door or window covering with which the vanes of the present invention may be employed;

FIG. 2 is a cross-sectional view taken along the line 2—2 of one of the vanes of FIG. 1;

In the various FIGURES, like reference numerals are used to indicate like components.

DETAILED DESCRIPTION OF THE PREFERRED EMBODIMENT

Figure 3:
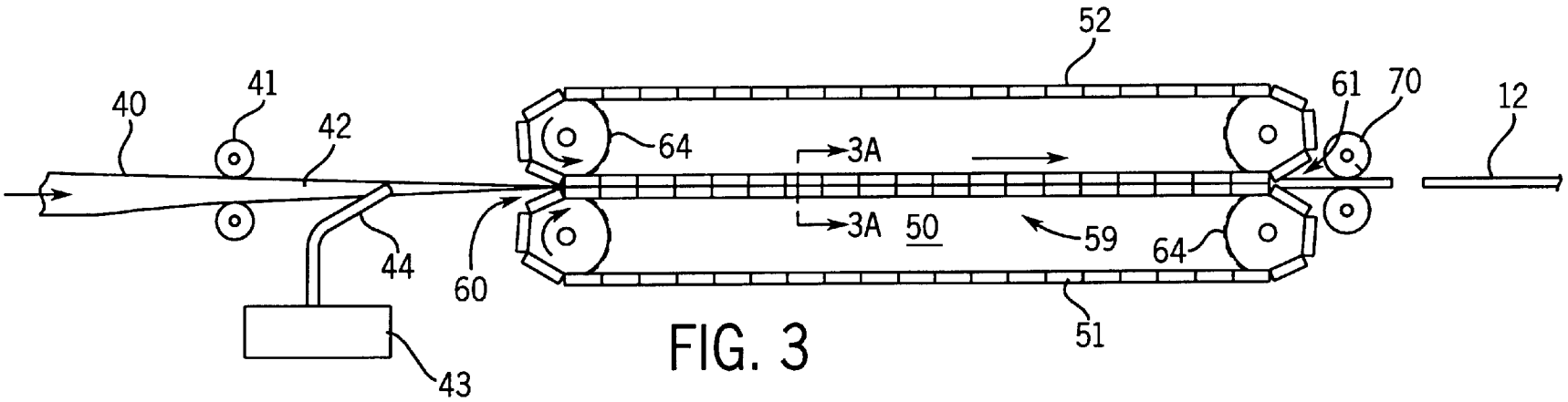
FIG. 3 is a schematic view of the manufacturing method and apparatus used for preparing the foam core vanes of the most preferred form of the present invention.

Before beginning the description of the preferred embodiment of the present invention and an alternative embodiment, several general comments should be made about the applicability and the scope of the present invention.

First, while the illustrated embodiment shows the vanes made with a foam core used in a vertical blind, the vanes could also be used in conjunction with other window covering designs known to the art, including the "blind with curtain" described in the aforementioned Ruggles, et al. patent or in various light control products in which one or two sheer fabrics are attached to the forward and rearward edges of the vanes.

Second, while the illustrated embodiment shows the vanes deployed in a vertical orientation, the vanes can be used in a horizontal system either with or without sheer fabric strips or sheets attached thereto. For example, the vanes could be manipulated and supported in the way typically practiced for venetian or mini-blind products in which a head rail and bottom rail are used together with lift cords for altering the distance between the bottom rail and the head rail, and tilting the vanes for light control.

Third, the cross-sectional shape of the vanes could also be widely varied without departing from the intended scope of the invention. The air foil shape of the illustrated embodiment is therefor for purposes of illustration, rather than limitation. The vanes could be prepared to have a symmetrical, oval, cross-sectional configuration, a configuration in which the vanes come to sharper points at both the forward and the rearward edges, vanes in which the cross-sectional shape is rectangular and, in connection with the latter, rectangles in which the foam core vanes are quite thin and resemble generally the types of slat vanes used with present day vertical blinds, or other cross-sectional shapes.

Fourth, the hardware used with the vanes of the present invention will not be described in detail because, in and of itself, the hardware does not form part of the present invention. Accordingly, such devices as the head rail, tracks, trucks, wands, pivot systems and the like can be selected from any of those currently known or developed subsequently as alternative for such present day products.

Fifth, polyurethane and isocyanurate foams are particularly preferred for use in the present invention because they are readily available and have been used for many years in furniture applications such as cushions for seating and for other insulation purposes for residential and commercial facilities. Other foams could also be used provided they have reaction times to allow them to fully inflate the fabric into the mold openings during the period the covering is captured within the mold cavities. Obviously, the time costs for manufacturing vane products will be lowest when the highest reactivity of the foam components is utilized. Furthermore, the foams may include well-known components for reducing flammability and/or smoke generation of the foams. The physical property of the foam itself can also be readily varied by those familiar with the foam art, so that the vanes could have a spongy feel when grasped or so that a more rigid foam is produced. Techniques for modifying the durometer, reaction speeds and physical properties of such foams are widely known and described in various texts dealing with foam chemistry and in product brochures of major manufacturers of the foam starting materials including polyols, isocyanates, catalysts and the like.

Sixth, the preferred and illustrated embodiment uses a single type of fabric for the entire outer covering of the vane. The material may be selected from woven and non-woven fabric materials of the type already known in the blind and door and window covering art including polyesters, polyolefins, rayons as well as natural materials such as cotton, linen, silk, wool or other fabric materials. Moreover, composite fabric starting strips can be used so that different sides of the vanes have different properties, such as color, light reflectancy, colorfastness and the like. Such composite fabric strips are known in the window covering art and are described, for example, in European Published Application No. EP 0 692 602 A1 (published 17.01.1996, Bulletin 1996/03) issued to the assignee of the present invention and describing the preparation of starting materials for cellular and light control products. The starting material is made by welding, such as by sonic welding, adjacent edges of fabric strips of two different types together. In that published application, the selection is generally made based on cost so that lower cost non-woven materials can be used for the exterior of a door or window covering and more expensive designer materials could be used for the portion of the product facing to the inside. Depending upon the final use of the foam core vanes of the present invention, the same considerations that govern the choice of materials in that published application could also be used for the selection of starting materials for foam core vanes.

Proceeding now to a description of the preferred embodiment of the invention, FIG. 1 illustrates a door or window covering 10 made from a plurality of elongate vanes 12. In the illustration, a valance 14 extends across the top of the opening to be covered and the cut away portion of the valance shows a track 16 mounted behind the valance on the wall or ceiling. Trucks 18, one for each of vanes 12, are mounted for sliding movement along track 12, the trucks 18 being interconnected with chains or other mechanisms (not shown) to maintain a preselected spacing between the trucks 18 when the door or window covering 10 is fully deployed across the opening as shown in the illustration. A clip 20 is provided at the top of each vane 12 for attaching the vanes 12 to the trucks 18. A wand 22 is also shown in FIG. 1 for deploying door or window covering 10 to an open position (as illustrated) wherein the trucks 18 and vanes 12 are spaced apart from one another or a closed position (not shown) in which the truck 18 and vanes 12 are bunched together at one side of the opening. Wand 22 could also be used for causing the clips 20 to rotate causing a 90° movement of each of vanes 12 from the FIG. 1 position, typically when the door or window covering 10 is fully deployed over the opening. It should be appreciated then that in such rotated positions, the vanes 12 will overlap one another at least partially, providing light control and privacy. As mentioned previously, the rotation of the vanes can be accomplished in a variety of well-known ways, such as using beaded chains and pulley mechanisms.

The cross-sectional configuration of vanes 12 according to the preferred embodiment is illustrated in FIG. 2. Vanes 12 are preferably shaped like an air foil having a blunt forward edge 24, a pair of gently curving sides 26 and 28 and a tapered, pointed edge 30. It will also be appreciated from this drawing that the vanes are comprised of a fabric outer covering 32 and a foam core 35. The illustrated vane 12 has the same fabric covering 32 extending about the entire core 35.

A preferred apparatus for preparing vanes 12 is schematically illustrated in the top view of FIG. 3. A strip 40 of starting fabric material is shown at the left side of the illustration and comes from a supply roll (not shown). Strip 40 progresses toward the right in FIG. 3 which will be the machine direction for purposes of the remaining description.

Strip 40 is folded using rollers 41, folding boards or other devices which are well-known in the door and window covering art so that the beginning of the forward edge 24 is created. Downstream of the rollers 41 a pocket section 42 is formed in strip 40, the section 42 being generally U-shaped in cross-section.

A pump 44 provides foam forming chemicals through a pipe 44 into the bottom of the pocket section 42. The pump in turn is supplied from a plurality of sources with individual foam forming chemicals, such as polyols, isocyanates, water or other ingredients well-known in the foam art. The mixture of the chemicals to form the foam reaction can take place in the pump 43, in pipe 44 or if separate conduits are provided in pipe 44, upon deposit of the ingredients in pocket section 42.

After the deposit of foam forming chemicals, the strip 40 enters a mold section 50 where right and left side mold halves 51 and 52 engage the strip and together define a cavity 57 having the desired final shape of the vane 12. In the schematic illustration, the mold halves 51 and 52 are shown as short segments which travel on a continuous oval track and which together define a straight section 59 between an entry point 60 and an exit point 61. Between points 60 and 61 the mold halves 51 and 52 form a continuous mold section having the desired final shape, i.e. a foil shape.

Other mold forming techniques could be used. For example, a pair of elastomeric mold halves could be employed and travel along a path similar to that depicted in FIG. 3. Each half of such an elastomeric mold could have the configuration of one half of a foil shape. Moreover, the drives for the moving mold components are not illustrated in detail, but could include a pair of cog wheels 64 at each end of mold section 50, one pair of which would be driven by a motor (not shown).

Figure 3A:
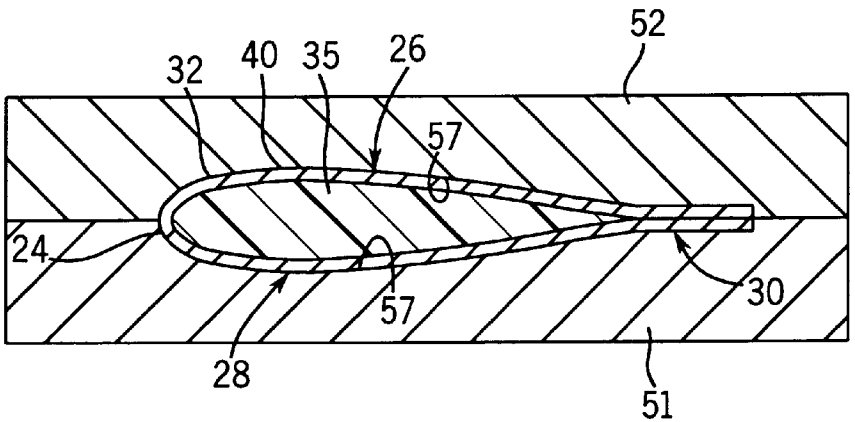
FIG. 3A is a cross-sectional view taken through the line 4—4 of FIG. 3.

During movement of strip 40 between points 60 and 61, a foam forming reaction takes place which forces the material of strip 40 outwardly toward the cavity 57 formed by mold halves 50 and 51. The foam reactants are selected to insure that the foam has completely reacted by the time the strip 40 reaches point 61. At such location, the foam will have completely pressed the fabric 32 against the interior of cavity 57 and formed a bond with the fabric 32. The core 35 will be generally uniform in foam density. By reference to FIG. 3A it will be noted that the sides 26 and 28 come to a point at end 30, and in some cases it may be advisable to add an adhesive or a sonic weld to this location to insure that the fabric covering 32 will not fray or unravel at the pointed edge. Such an adhesive could be applied upstream of point 60 from a hot melt adhesive bead applicator or could be provided as a sealant immediately upon the passage of vane 12 beyond point 61.

The final component of the schematic apparatus shown in FIG. 3 is a rotary cut off knife 70 which cuts the completed vane precursor into the individual vanes 12.

While the in situ formation of the foam core 35 within fabric coating 32 is preferred, the core 35 can also be prepared separately and the covering 32 can thereafter be wrapped about the core. Alternatively, the fabric covering 32 can be formed in the shape of a hollow tube and thereafter the formed foam core can be inserted therein. In either case, an adhesive may be applied to the inside of the fabric cover 32 or over the foam core 35 to form a bond between the fabric and foam or the foam core 35 can be frictionally held within the cover 32.

Figure 4:
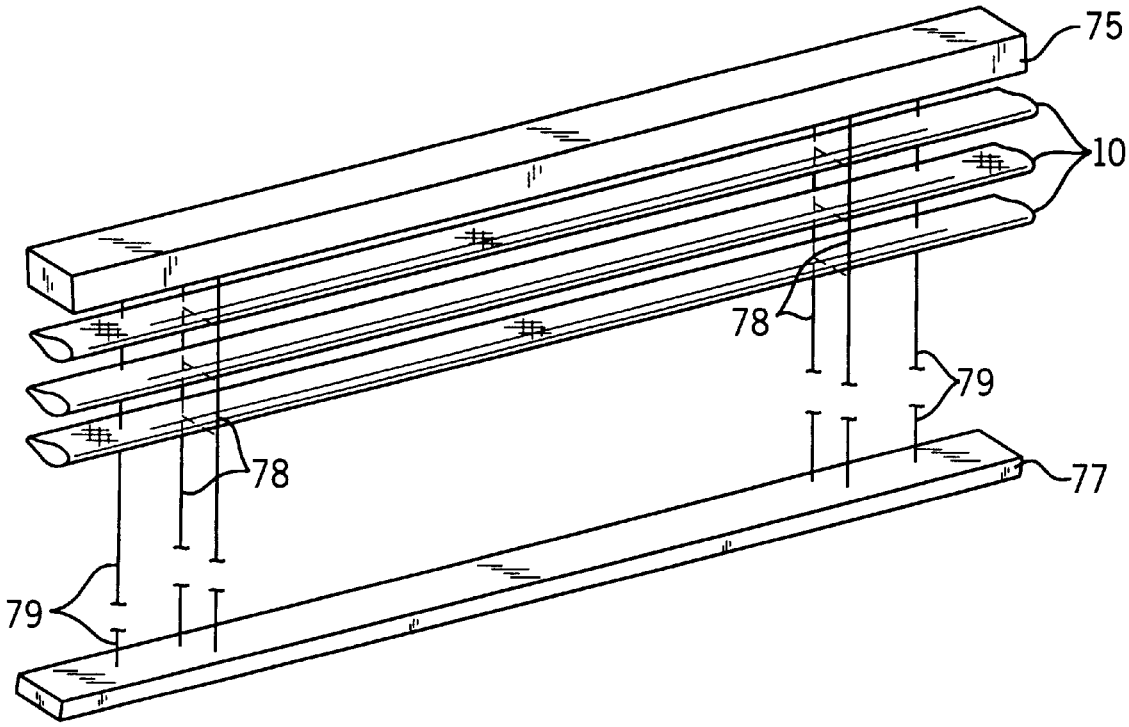
FIG. 4 is a perspective view showing the vanes of the present invention in a horizontal orientation, only three of the vanes being shown, together with a head rail, bottom rail, lift cords and ladder cords.

A partial perspective view showing the vanes 10 of the present invention used in a horizontal orientation is shown in FIG. 4. A head rail 75 and a bottom rail 77 are illustrated in schematic form, with ladder cords 78 and lift cords 79 extending therebetween. Those skilled in the art will appreciate that mechanisms may be located in the head rail, bottom rail or both to raise and lower the bottom rail with respect to the head rail and to tilt the ladder cords to move the vanes 10 from a closed position in which they are generally parallel with one another to an open position in which they are substantially parallel. As mentioned previously, the hardware, lifting and tilting mechanisms are not, in and of themselves, part of the present invention and are hence not shown in detail.

While the present invention has been described in connection with a preferred embodiment and an alternate embodiment for the deployment of the vanes, it is not to be limited to the illustrated embodiment but is to be limited solely by the scope of the claims which follow.

What is claim is:

1. A door or window covering comprising:

a plurality of elongate vanes;

means for suporting the vanes for pivotal movement about the longitudinal axis of each vane;

means for pivoting each vane about the longitudinal axis;

means for supporting the vanes in a parallel relationship with respect to other vanes and for changing the spacing between the vanes; and wherein each vane consists essentially of a fabric outer covering and polymeric foam substantially filling the interior of each vane.

2. The door or window covering of claim 1 wherein the vanes are deployed vertically and the support means are located at an end of each vane.

3. The door or window covering of claim 1 wherein the vanes are deployed horizontally and the support means contact each vane at least two locations spaced along the length of each vane.

4. The door or window covering of claim 1 wherein the fabric is selected from the group consisting of woven and non-woven fabrics.

5. The door or window covering of claim 1 wherein the polymeric foam is selected from the group consisting of urethane and polyisocyanurate foams.

6. The door or window covering of claim 1 wherein each vane has a transverse cross-section identical to that of each of the other vanes.

7. The door or window covering of claim 6 wherein each vane has a blunt rounded first edge, a pair of curved sides and a second pointed end formed by the sides tapering toward one another.

8. The door or window covering of claim 1 wherein the foam is bonded to the fabric.

9. The door or window covering of claim 8 wherein the bond results from forming the foam while it is in contact the fabric.

10. The door or window covering of claim 8 wherein the bond is an adhesive bond.

11. A method for preparing a vane for door or window coverings comprising the steps of:

providing an elongate strip of fabric having first and second sides;

depositing foam forming liquid chemicals along the length of the strip on a first side thereof;

folding the elongate strip;

providing a mold about the folded elongate strip, the mold having an interior surface;

allowing the chemicals to react to form a foam and urge the second side of the strip into substantially uniform contact with the mold interior surface; and removing the mold after the chemicals have completed their reaction.

12. The method of claim 11 wherein the method is continuous and the elongate strip is provided from a supply roll and is moved along a path.

13. The method of claim 12 wherein the depositing step comprises depositing a bead of the liquid chemicals from one or more nozzles as the strip is moved with respect to the nozzles.

14. The method of claim 13 wherein the step of providing a mold comprises providing first and second travelling mold cavities which together surround the strip after the chemicals have been deposited.

15. The method of claim 12 comprising the further step of cutting the vanes to a preselected length.

16. The method of claim 11 wherein the chemicals include at least a polyol, an isocyanate and a means for initiating a foam forming reaction between the polyol and the isocyanate.

17. The method of claim 11 wherein a first portion of the folding step occurs before the depositing step and additional folding of the strip occurs after the depositing step.

18. The method of claim 11 wherein the mold interior surface has a cross-sectional shape having a blunt first end, curved sides and a pointed end formed by the sides tapering toward one another.

* * * * *